United States Patent [19]

Bonacci et al.

[11] Patent Number: 4,712,598

[45] Date of Patent: Dec. 15, 1987

[54] SCREEN DOOR ASSEMBLY

[76] Inventors: Stephen T. Bonacci, 202 Mitchell Ave.; Richard L. Douville, 3322 W. Third Ave.; Rodger C. Winter, Rte. #1-Box 119E, all of Hibbing, Minn. 55746

[21] Appl. No.: 920,068

[22] Filed: Oct. 17, 1986

[51] Int. Cl.[4] ..... E06B 3/94

[52] U.S. Cl. ..... 160/84 R; 160/327

[58] Field of Search ..... 160/84 R, 113, 368 R, 160/201, 327, 40, 41

[56] References Cited

U.S. PATENT DOCUMENTS

| | | | |
|---|---|---|---|
| 1,482,059 | 1/1924 | Zimmer | 160/84 R |
| 3,023,804 | 3/1962 | Howell, Sr. | 160/201 X |
| 3,055,419 | 9/1962 | Rubin et al. | 160/84 R |
| 3,056,451 | 10/1962 | Federline et al. | 160/201 |
| 3,259,151 | 7/1966 | Schmitz | 160/349 |
| 3,487,875 | 1/1970 | Shukat et al. | 160/84 R |
| 3,763,917 | 10/1973 | Antinone | 160/368 R |
| 4,069,857 | 1/1978 | Brookshire | 160/84 R |
| 4,317,481 | 3/1982 | Oswald | 160/84 R |
| 4,335,774 | 6/1982 | Price | 160/84 R |
| 4,569,383 | 2/1986 | Wentzel | 160/201 |

FOREIGN PATENT DOCUMENTS

| | | | |
|---|---|---|---|
| 1270759 | 6/1968 | Fed. Rep. of Germany | 160/84.1 |

*Primary Examiner*—Ramon S. Britts
*Assistant Examiner*—David M. Purol
*Attorney, Agent, or Firm*—D. L. Tschida

[57] ABSTRACT

An externally mounted, insect-proof screen curtain assembly for large door openings. The curtain is raised and lowered via draw pulley supported ropes, vertically threaded through rings sewn to the curtain material. Spaced apart horizontal rope containing hems and a bottom weight member maintain a flat exposed screen surface relative to slide track mounted side hems. Flexibly resilient side seal members mounted in wiping relation to the screen sides, along with a compressible horizontal bottom seal and a fixed head seal, make the assembly insect-proof.

9 Claims, 7 Drawing Figures

SCREEN DOOR ASSEMBLY

BACKGROUND OF THE INVENTION

The present invention relates to garage door covers and, in particular, to an exteriorly mounted insect-proof draw pulley actuated screen curtain.

Regardless of climate, one of the largest expanses of living and working space not utilized to its maximum by most homeowners is that offered by way of the floor space available in most garages. During the winter months for the northern climates, certainly this space is not available, due to occupancy by the homeowner's automobiles. However, during the warmer months of the year, it could be more effectively utilized by merely parking the cars outside.

One principal drawback to the above, though, is that with the warmer weather and the homeowner's increased desire to spend time outdoors, concomitantly, insects such as flies and mosquitoes are present. To close the garage doors oftentimes means that the interior spaces become too hot so even though the space is available, for all practical purposes, it is unusable.

A solution to this problem is to mount a screen door-like assembly over the garage door opening, but which assembly must accommodate the operation of the primary garage door. Some examples of rigid frame screen assemblies of which applicant is aware can be found in U.S. Pat. Nos. 2,423,987; 3,938,577; and 4,231,412. In the U.S. Pat. No. 4,231,412, a two-panel assembly is pivotally suspended to the top of the door such that when raised, the panels project outwardly at right angles to the garage exterior. The U.S. Pat. No. 3,938,577 discloses a hinged assembly which stores in piggy-back relation to the garage door, but which may be released from the door, when raised, and brought to bear in covering relation to the door opening. The U.S. Pat. No. 2,423,987, in turn, discloses a multi-panel track mounted assembly having an overlying canopy for storing the folded hinged panels.

One other air permeable, flexible door assembly of which applicant is aware is disclosed in U.S. Pat. No. 4,197,897 and wherein a draw pulley actuated clear plastic panel covering is disclosed which utilizes side mounted zippers to seal the assembly against air infiltration.

Even though various of the foregoing assemblies achieve comparable end results, deficiencies are perceived in the use of rigid frame sections which are costly to fabricate and difficult to maintain and not tolerant of strong winds, given the contemplated expanses. Such assemblies are also not particularly accommodating of being sealed to prevent against insect intrusion, when closed. Thus, it is a principal purpose of the present invention to provide an assembly accommodating of most existing garages and garage door operators, while providing minimized storage requirements and maximum protection against insect intrusion.

SUMMARY OF THE INVENTION

It is accordingly a primary object of the invention to provide for an insect-free screen curtain assembly mountable to a variety of differently sized garage door openings, without undue modification or inventory requirements.

It is another object of the invention to provide for a draw pulley assembly for raising and lowering the curtain relative to side mounted tracks and captured slide members.

It is a still further object of the invention to provide seal members mounted in wiping engagement to the curtain sides and at head and sill portions to seal the opening against intrusion by insects.

It is yet another object of the invention to provide means for maintaining a relatively taut curtain surface when lowered, yet fold into a compact space when raised.

These and other objects are achieved in the preferred embodiment of the present invention wherein an externally suspended slide track mounted screen curtain assembly is disclosed. Curtain operation is achieved via a plurality of vertical pull cords threaded through rings attached to the curtain and accessible from the garage interior. A weighted tensioner and a plurality of horizontally hemmed rope members maintain a taut surface exposure and facilitate the storage of the curtain beneath a protective canopy, when raised. Compressible head and sill seal members, along with flexible side seal members mounted in wiping relation to the curtain sides, in turn, seal the curtain against insect intrusion.

Sliding operation is maintained at the hemmed curtain sides via H-shaped slide clips mounted in mating relation to the slide tracks. The clips are secured to the curtain at the knotted end of each horizontal hemmed rope and stub rope mounted therebetween. Each rope end is also threaded through an intermediate strain-relieving grommet.

The above objects, advantages and distinctions of the present invention, along with others, as well as the details of its construction, will become more apparent upon reference to the following description thereof with respect to the appended drawings. Before turning attention to the description though, it is to be appreciated that it is made by way of the presently preferred embodiment only and is not intended to be all-inclusive and thus should not in any way be interpreted as self-limiting. To the extent that modifications may have been contemplated, they will be referenced as appropriate in the description of the invention.

Figure 1:
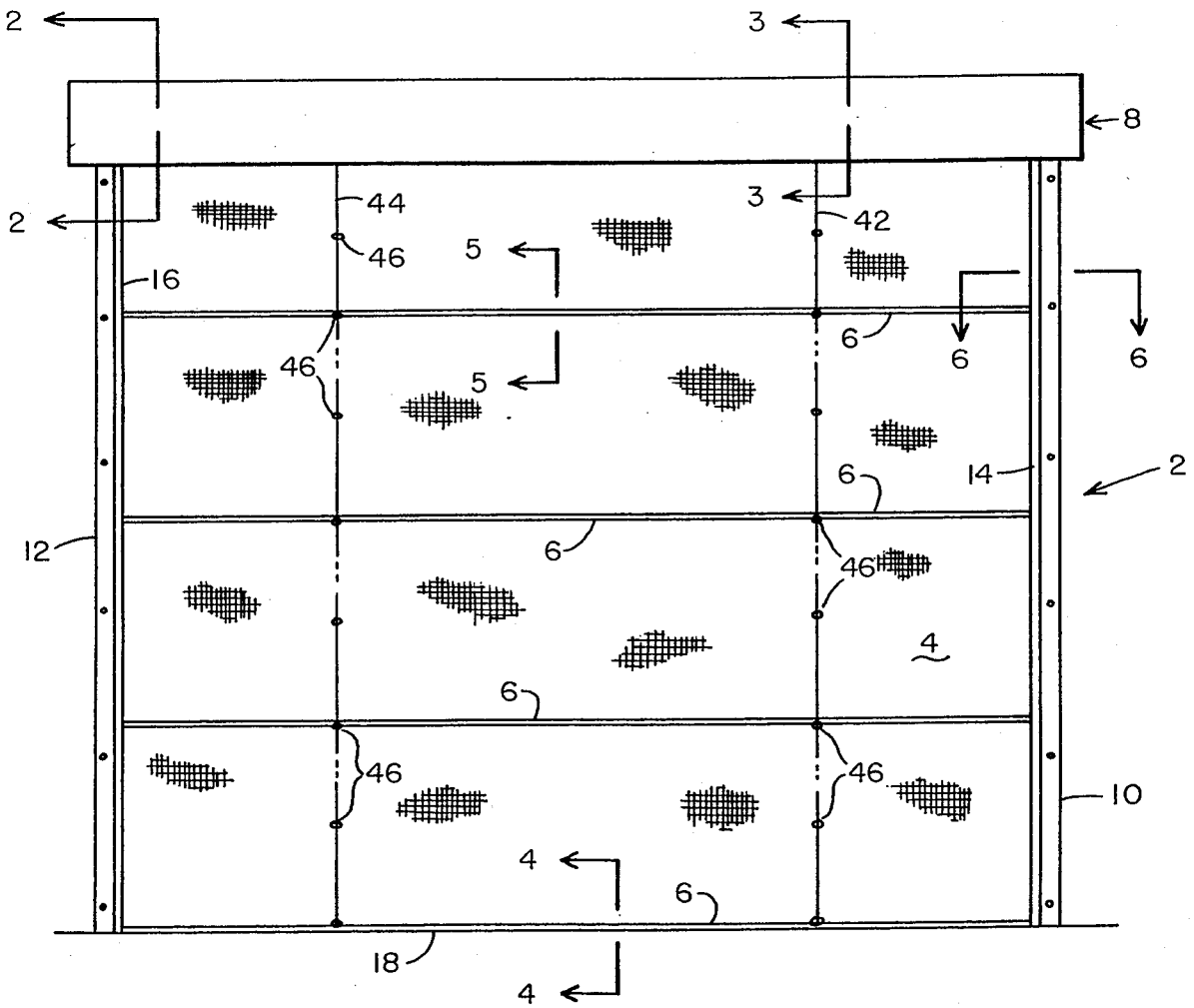
FIG. 1 shows a front elevation view of the present screen curtain assembly in mounted relation to a garage door opening.

FIG. **6*a* shows a cross-section view, taken along reference lines 6—6 of FIG. 1**, of the detailed mounting relation of the curtain side hem to the slide track and insect seal.

Figure 6B:
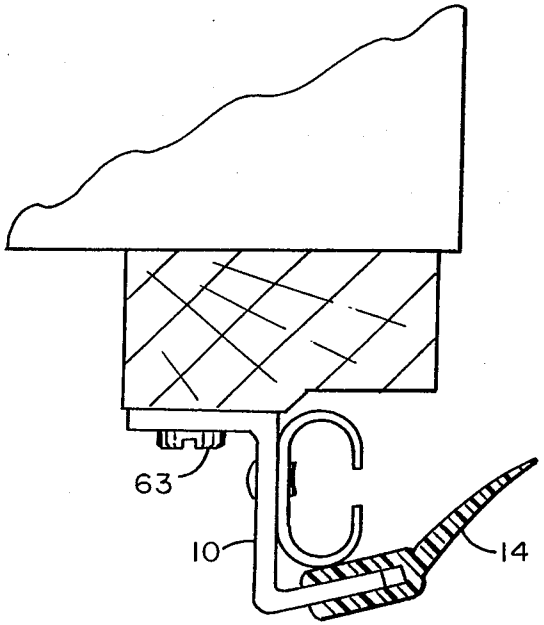
Figure 6A:
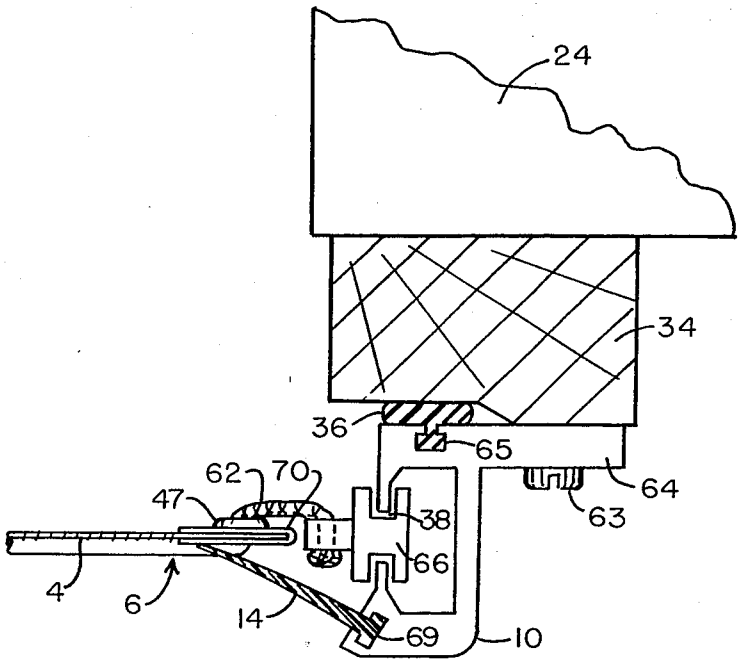

FIG. **6*b* shows a cross-section view, like that of FIG. 6a**, for an alternative embodiment of a composite slide track assembly.

DESCRIPTION OF THE PREFERRED EMBODIMENT

With attention first directed to FIG. 1, a front elevation view is shown of the present screen door assembly 2 in mounted relation to a typical garage door opening. Constructionally, it is comprised of a cloth-like multipanel screen curtain 4 which is of a sufficient size to cover the opening and flexible enough to bunch up about the horizontal hems 6 as the curtain 4 is raised and lowered. Such a material reduces storage space and allows the curtain to be stored beneath the overlying canopy 8 mounted to the external surface of the opening in the area of the door header.

Mounted to the right and left sides of the door opening, along the brick molding or other molding typically provided thereat, are a pair of vertical slide channels 10 and 12 which slidably restrain clip members (not shown) that are secured to the curtain 4's side hems at each of the horizontal hems 6 and midway between each hem 6. The details thereof will however be described hereinafter with respect to FIGS. 6*a* and 6*b*. Depending upon the curtain size, more or less of such clips may be employed so long as the curtain 4 operates smoothly and remains reasonably taut across its front surface.

Flexible side seal members 14 and 16 mount within the respective side channels 10 and 12 and wipingly engage the exterior curtain face to seal the sides against intrusion by insects. Similarly, the top and bottom edges of the curtain 4 mount in sealed relation to the exterior surface of the garage and the ground. In particular, the upper curtain edge is permanently mounted to the exterior garage surface, while a flexibly compressible seal 18 mounted along the horizontal bottom curtain edge engages and conforms to the ground.

Due to the external mounting of the assembly 2, it may be operated independent of the framed garage door and its associated track assembly. Thus, the assembly 2 may be used with almost all existing garage doors, whether they are of a vertical torsion spring, side spring and pulley, slide-by or rigid pivoting operation. For the latter type of operator, however, and wherein the door typically extends outwardly of the building frame over a portion of its travel as it is raised, it would be necessary to partially raise the screen assembly 4, if it were down, before raising or lowering the frame door. Otherwise, though, no special precautions or framing detail need be performed with the present assembly 2. As depicted, it is also to be appreciated that the assembly 2 is raised and lowered via an internally mounted operator that will be described in greater detail with respect to FIG. 3, although alternatively, it may be operated via an external operator. Thus, regardless of the door's operating mechanism, the present screen assembly can be made to be compatible therewith.

From a materials standpoint, the assembly 2 is designed to be resistant to typically encountered weather conditions. That is, the screen curtain in the presently preferred embodiment is fabricated from a woven fiberglass/plastic material, while the canopy 8 and side track members 10 and 12 are constructed of galvanized or anodized metal. The seals 14 and 16 are constructed of nylon and the bottom seal 18 of naugahyde. Other materials, however, such as polyvinyl or various plastics, may also be used equally well. Most such materials are also accommodating of a variety of colors and of which the more neutral earth tones are preferred so not to detract from the building's color scheme.

Figure 3:
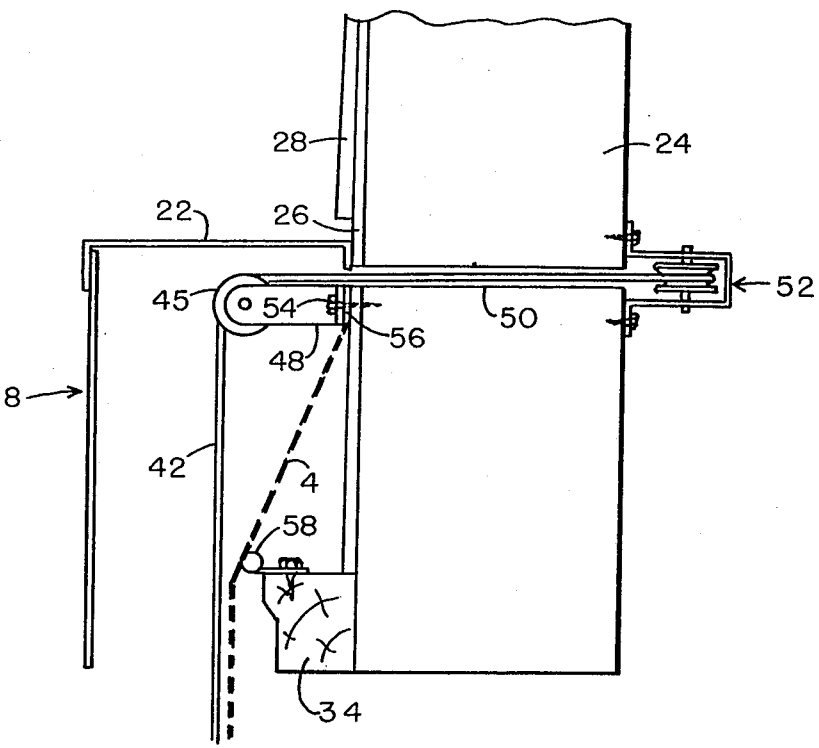
FIG. 3 shows a cross-section view, taken along reference lines 3—3 of FIG. 1, of the draw pulley assembly used to raise and lower the screen curtain.
Figure 2:
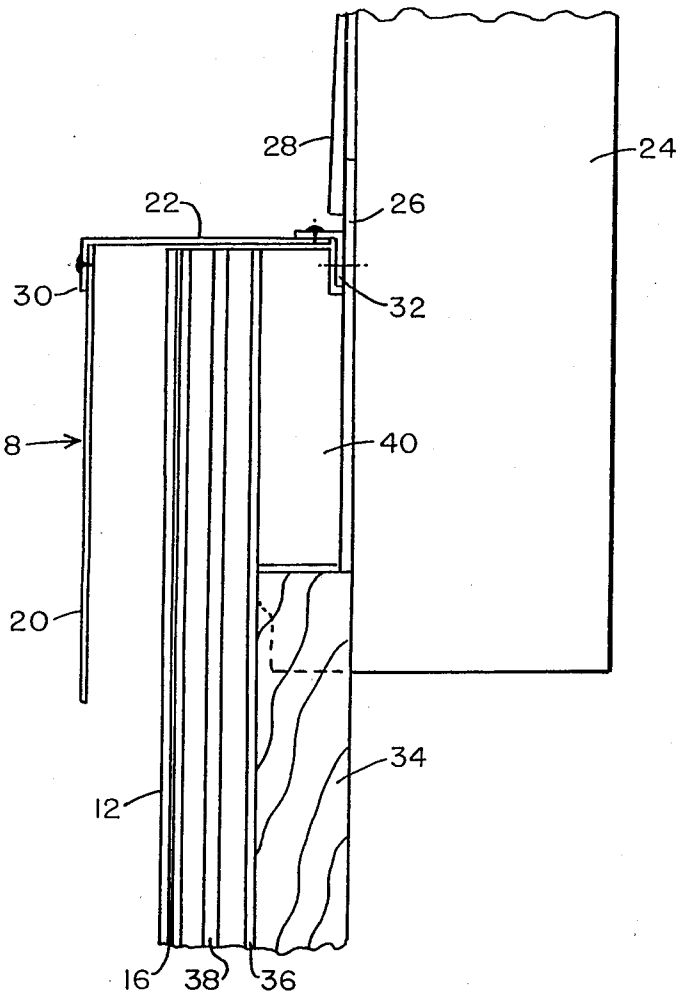
FIG. 2 a cross-section view, taken along reference lines 2—2 of FIG. 1, of the slide tracks and canopy side seals.

Appreciating that the canopy 8 obstructs various of the assembly detailing, attention is next directed to FIGS. 2 and 3 and wherein the mounting relation of the canopy 8 and side channel 12 to the exterior garage surface and of the draw pulley operator system used to raise and lower the curtain 4 are shown. Referring first to FIG. 2, a cross-section view, taken along reference lines 2—2 of FIG. 1, is shown of the end of the canopy assembly 8. From this view, it can be seen that the canopy 8 comprises a front valance portion 20, an overlying drip cap portion 22 and an angle member 32 attached to the building. In the preferred embodiment, the valance 20 and drip cap 22 are constructed of anodized aluminum or galvanized/painted sheet metal with the valance being approximately twelve inches tall and the drip cap 22 extending approximately five to six inches away from the building exterior. The front edge of the drip cap 22 includes a right angle bend portion 30 which along with the rear angle member 32 act as anchor points for the flat valance 20 and cap 22 which are attached thereto via welding, rivets or other fasteners. Screw fasteners or the like, in turn, secure the angle member 32 to the building exterior.

As depicted, the canopy 8 is shown in general relation to the garage framing members 24 (i.e. header, studs etc.), insulation board 26 and lap siding 28. It is to be appreciated though that the invention is compatible with other types of facades, be it brick, stucco or other conventional siding materials.

Extending upwardly beneath the canopy is the left slide track member 12 which extends full height from the ground to the drip cap 22. It is secured at a number of points to the brick molding 34, which typically surrounds the door opening, via associated fasteners mounted through a flanged track portion extending outwardly at right angles to the body of the track 12 (reference FIG. 1). An optional seal member 36 seals the back face of the track 12 against the building surface. A slideway 38 is provided along the longitudinal center of the track 12 and the flexible side seal 16 mounts in a longitudinal groove along the outer edge of the track body.

Regardless of whether end caps are included at the right and left sides of the canopy 8, still another flexible nylon seal member 40 is secured in the space between the back edge of the side track 12 and the insulation board 26 in abutting relation to the side hem of the curtain 4. This seal also prevents against insert intrusion.

As mentioned, the curtain 4 is raised and lowered via a draw pulley assembly which may be seen in FIG. 3 from a cross-section view taken along reference lines 3—3 of FIG. 1. Specifically, FIG. 3 shows a view of the pulley assembly relative to pull cord 42, which is mounted to the right side of the curtain 4. A second pull cord 44 is similarly mounted to the left side of the curtain 4.

Each of the cords 42 and 44 is alternately threaded through a plurality of vertically disposed rings 46 which are sewn to the curtain face midway between and at each hem 6. Each ring 46 is particularly secured with a naugahyde loop that is sewn to the curtain 4 to allow the ring 46 to pivot therein. Thus, the cords 42 and 44 are exposed on the exterior side of the curtain 4 and induce the curtain 4 to bunch up at the horizontal hem 6 and center grommets 46 as the curtain 4 is raised.

Mounted to the garage framing 24 and supporting the cord 42 in its V-channel is an overlying pulley 45 and bracket 48 which together facilitate the raising/lowering of the curtain 4. The cord 42, after passing over the pulley 45, extends through a prepared passage 50 (e.g. a short length of pipe) formed through the framing 24 to an interior pulley assembly 52 which redirects the cord 42 towards the interior left side of the opening, where the cords 42 and 44 are redirected downwardly via other pulleys (not shown) and are joined. Thus, a number of pulleys 45 mounted to the framing guide the cord travel, such that the cords 42 and 44 may be operated in unison to raise/lower the entire curtain 4 or, alternatively and independently of one another, to tip the curtain 4 without completely exposing the garage door opening.

From FIG. 3, it is also to be appreciated that the upper end of the curtain 4 is bound to the framing 24 via screw fasteners 54 and a horizontal clamp plate 56. Depending upon whether or not brick molding 34 is provided along the upper edge of the door opening, an optional offset polyvinyl relief member 58 may be used to relieve the strain on the curtain 4 and prevent its wearing against the outer edge of the molding 34. Alternatively, the edges of the molding contacting the curtain 4 may be rounded or chamfered to prevent snagging/tearing.

Figure 5:
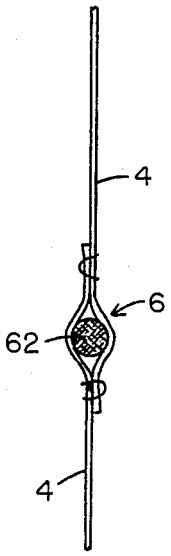
FIG. 5 shows a cross-section view, taken along reference lines 5—5 of FIG. 1, of the rope and curtain tensioner.
Figure 4:
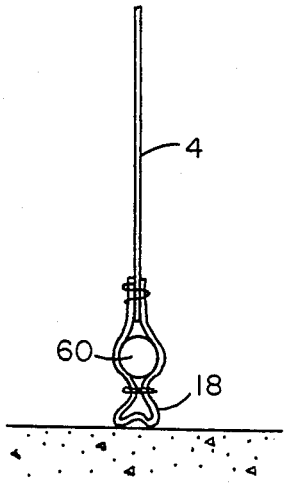
FIG. 4 shows a cross-section view, taken along reference lines 4—4 of FIG. 1, of the compressible bottom curtain seal.

With attention next directed to FIGS. 4 and 5, detailed cross-sectional views are shown through the curtain 4 at its bottom horizontal edge and at one of its hems 6. From FIG. 4, it is to be noted that a U-shaped nylon bottom seal 18 is sewn at its open end to the curtain material just above a horizontally disposed weighted rod 60. The seal 18 itself is also hemmed just below the rod 60 to minimize its subsequent movement and to allow a remaining lower flexible loop portion along the bottom edge to contact and conform to the ground. The seal 18, like the seals 14, 16 and 40, acts as a barrier to insects, mice etc. In lieu of attaching a separate seal member 18, the curtain 4 itself may be looped at its edge with the rod 60 hemmed therebetween, although a separate seal is preferred. Together, however, the rod 60 and seal 18 tend to stiffen the curtain 4 and improve its appearance. The rod 60 also serves to weight the curtain 4 to prevent hang-ups when raising/-lowering the curtain.

From FIG. 5, a cross-section view is shown through curtain 4 at one of its hems 6 and wherefrom a horizontally disposed cord member 62 is hemmed between overlapping panels of the curtain material which are sewn together just above and below the cord 62. Together, the cords 62 of each of the hems 6 add horizontal rigidity and weight to the assembly 2 to further maintain the curtain 4 in taut relation to the door opening, when lowered. The cords 62 also facilitate the folding and bunching of the material thereabout as the curtain 4 is raised/lowered.

With attention lastly directed to FIGS. 6*a* and 6*b*, detailed cross-section views, taken along reference lines 6—6 of FIG. 1, are respectively shown relative to the preferred mounting of the curtain 4 to the slide track 10 at one of the side hems 6 and an alternative slide track construction. In this latter regard, the slide track of FIG. 6*a* is constructed as a contiguous member, whereas in FIG. 6*b*, it is comprised of various equivalent separable elements. That is, the track body comprises riveted Z-shaped and C-shaped portions and nylon seal 14 mounted over the end of the Z-shaped portion of the track body. Functionally, though, each track construction is equivalent to the other.

In any case and directing attention to FIG. 6*a*, the slide track 10 is secured to the brick molding 34 via screw fasteners 63 disposed along and through the orthogonal flange 64 of the track body that extends outwardly along its outside edge. An optional polyvinyl seal member 36, in turn, mounts within a groove 65 let into the rear track face and, as the track 10 is drawn against the molding 34, is slightly compressed to weather-seal the track.

Slidably positioned within the slideway 38 is an H-shaped slide clip 66 which is secured at an extreme end of one of the cords 62. That is, the cord 62 is threaded through a strain relief grommet 46 and a hole containing portion 68 of the clip 66, whereat the cord 62 is knotted. Similarly, the ends of each hem 6 support a clip 66, while each intermediate clip 66 is secured in a comparable fashion to a stub cord (not shown) sewn to the curtain hem. Together the clips then slidably support the curtain relative to the slide tracks 10 and 12.

Appreciating that a gap exists between the curtain 4's side hem and the track 10, the flexible seal member 14 is mounted within a groove 69 let into the track 10 so as to contact the curtain 4 in a vertically disposed, wiping relation. The seal 14 is constructed of polyvinyl and is flexible enough to deflect with the raising and lowering of the curtain 4, but spring back into contact therewith as it is lowered to create an insect-proof side seal. In passing, it is to be noted that this contact is improved by sewing a nylon facing 70 to the side hem which is contacted by the tip of the seal 14.

From the foregoing, it is to be appreciated that the invention provides for an externally mounted screen curtain assembly adaptable to most garage openings, irrespective of the primary door operation. The assembly is weatherproof and insect-proof and thereby allows the homeowner to better utilize the sheltered space provided by conventional garages in reasonably ventilated comfort during the summer months.

While the invention has been described with respect to its presently preferred embodiment, it is to be appreciated further that changes may be made thereto by those of skill in the art without departing from the spirit and scope thereof. Accordingly, the following claims should be interpreted to include all those equivalent embodiments within the spirit and scope thereof.

What is claimed is:

1. A ventillated cover for a garage door opening comprising:

(a) a screen curtain sized to extend beyond the sides and top of said opening and having a plurality of horizontally disposed cord members sewn thereto, wherein a topmost edge is mounted in sealed external relation above the top of said opening and a bottommost edge is hemmed to support a horizontally disposed weighted rod and beneath which a compressible seal member is mounted, wherein each of a plurality of rings are attached to the face of said curtain in vertical columns and wherein the curtain sides are hemmed and grommets are set therein at the outer hem edges in alignment with each cord and the ends of which cords are threaded through each of said grommets;

(b) a pair of vertical track members mounted in sealed external relation to the sides of said opening, each track member including a vertical flanged slideway and a flexible vertical seal member positioned to angulate from an outer track edge;

(c) a plurality of slide clip members, each secured to an end of one of said cord members and slidably constrained in one of said vertical tracks; and (d) draw pulley means including a plurality of vertically disposed draw cords threaded through said rings for raising and lowering said curtain and such that said bottom compressible seal conformally engages the ground and said track mounted seals contact said curtain when fully lowered.

2. Apparatus as set forth in claim 1 wherein each ring is attached to said curtain via a strip member looped through each ring and sewn to the curtain face.

3. Apparatus as set forth in claim 1 including a canopy having an open bottom mounted in surrounding relation to the top of said curtain for protectively storing said curtain therebeneath when fully raised.

4. Apparatus as set forth in claim 1 including means for directing said draw cords interiorly and to one side of said opening, whereby said curtain may be raised/-lowered from within the building.

5. Apparatus as set forth in claim 1 including a horizontally disposed seal member mounted in sealed external relation to the garage to contact the inner face of said curtain at the top of said opening.

6. Apparatus as set forth in claim 1 wherein the compressible member comprises a cross-sectionally U-shaped extrusion sewn to the bottom of said curtain which conforms to the ground to seal thereagainst.

7. Apparatus as set forth in claim 1 wherein each of said clip members is cross-sectionally H-shaped and is secured to one of said cords at an inner hole containing portion.

8. A ventilated cover for a garage door opening comprising:

(a) a screen curtain sized to extend beyond the sides and top of said opening and comprised of a plurality of rectangular panels, each panel sewn along its horizontal edges to an adjacent panel, having a plurality of horizontally disposed cord members sewn therebetween at each horizontal seam, wherein the topmost edge is mounted in sealed external relation above the top of said opening and the bottommost edge is hemmed to support a horizontally disposed weighted rod and beneath which a compressible seal member is mounted, wherein each of a plurality of rings are attached to the face of said curtain via a strip member looped through each ring and sewn to said curtain in vertical columns at each seam and at the center of each panel and wherein the curtain sides are hemmed and grommets are set therein at the outer hem edges in alignment with each cord and the ends of which cords are threaded through each of said grommets;

(b) a pair of vertical track members mounted in sealed external relation to the sides of said opening, each track member including a vertical flanged slideway and a flexible vertical seal member positioned to angulate from an outer track edge;

(c) a plurality of slide clip members, each secured to an end of one of said cord members and slidably constrained in one of said vertical tracks;

(d) a horizontally disposed seal member mounted in sealed external relation to the garage to contact the inner face of said curtain at the top of said opening; and (e) draw pulley means including a plurality of vertically disposed draw cords threaded through said rings for raising and lowering said curtain and wherein said compressible seal engages the ground and said track mounted seals and said top seal engage said curtain when fully lowered to seal said opening.

9. A ventilated cover for a garage door opening comprising:

(a) a screen curtain sized to extend beyond the sides and top of said opening and having a plurality of horizontally disposed cord members sewn thereto, wherein a topmost edge is mounted above the top of said opening and a bottommost edge is hemmed to support a horizontally disposed weighted rod and beneath which a compressible seal member is mounted, wherein each of a plurality of rings are attached to the face of said curtain and wherein the curtain sides are hemmed and grommets are set therein at the outer hem edges in alignment with each cord and the ends of which cords are threaded through each of said grommets;

(b) a pair of vertical track members mounted in sealed external relation to the sides of said opening, each track member including a vertical flanged slideway and a flexible vertical seal member positioned to angulate from an outer track edge;

(c) a plurality of slide clip members, each secured to an end of one of said cord members and slidably constrained in one of said vertical tracks;

(d) draw pulley means including a plurality of vertically disposed draw cords threaded through said rings for raising and lowering said curtain and such that said bottom compressible seal conformally engages the ground and said track mounted seals contact said curtain when fully lowered; and (e) a horizontally disposed seal member mounted in sealed external relation to the garage to contact the inner face of said curtain at the top of said opening.

* * * * *